US009086200B2

(12) United States Patent
Aguiar et al.

(10) Patent No.: US 9,086,200 B2
(45) Date of Patent: Jul. 21, 2015

(54) THERMAL MANAGEMENT SOLUTION FOR CASE CORNER LIGHTING SYSTEM

(75) Inventors: Fernando Aguiar, Westport, MA (US); Camil-Daniel Ghiu, Danvers, MA (US); Robert Harrison, North Andover, MA (US); Gregory McCord, Raleigh, NC (US)

(73) Assignee: OSRAM SYLVANIA Inc., Danvers, MA (US)

( * ) Notice: Subject to any disclaimer, the term of this patent is extended or adjusted under 35 U.S.C. 154(b) by 589 days.

(21) Appl. No.: 13/412,220

(22) Filed: Mar. 5, 2012

(65) Prior Publication Data

US 2013/0229790 A1 Sep. 5, 2013

(51) Int. Cl.

| | |
|---|---|
| ***F25D 27/00*** | (2006.01) |
| ***F27D 21/02*** | (2006.01) |
| ***F21S 8/00*** | (2006.01) |
| ***A47F 3/00*** | (2006.01) |
| ***F21V 29/00*** | (2015.01) |
| ***F21V 15/01*** | (2006.01) |
| ***F21V 25/00*** | (2006.01) |
| ***A47F 11/10*** | (2006.01) |
| *F21W 131/405* | (2006.01) |

(52) U.S. Cl.

CPC ..... *F21S 8/037* (2013.01); *A47F 3/001* (2013.01); *A47F 11/10* (2013.01); *F21V 15/01* (2013.01); *F21V 25/00* (2013.01); *F21V 29/004* (2013.01); *A47B 2220/0077* (2013.01); *F21W 2131/405* (2013.01)

(58) Field of Classification Search

CPC ..... F21S 6/005; F21S 8/037; F21S 8/00; F21V 29/22; F21V 19/004; F21V 33/0044; F21V 21/088; F21V 21/30; F21V 17/164; F21V 17/04; F21V 17/104; F21V 13/04; A47F 5/0043; A47F 11/10; A47F 3/001; A47F 3/0426; F25D 27/00; F25D 25/04

USPC ..... 362/418, 217.05, 249.01, 373, 92, 125, 362/133, 126, 132, 329, 294, 217.16, 269, 362/217.14, 217.15, 217.17

See application file for complete search history.

(56) References Cited

U.S. PATENT DOCUMENTS 4,748,545 A 5/1988 Schmitt
4,979,078 A * 12/1990 Amstutz et al. ..... 362/125

(Continued)

OTHER PUBLICATIONS

Antoniu Arboreanu, International Search Report and Written Opinion of the International Searching Authority for PCT/US2013/020876, Mar. 14, 2013, pp. 1-9, European Patent Office, Rijswijk, The Netherlands.

*Primary Examiner* — Thomas A Hollweg
*Assistant Examiner* — Kevin Quarterman
(74) *Attorney, Agent, or Firm* — William H. McNeill; Shaun P. Montana

(57) ABSTRACT

A thermal management system for a display case having a corner in which a lighting system is located is provided. The lighting system includes a reflector and a light source that generates heat and is mounted with the reflector. A lighting system support is positioned in the corner of the display case and is associated with the lighting system. A mullion is positioned between the lighting system support and the lighting system. The mullion maintains a desired relative position between the lighting system support and the lighting system. A contactor is located between the lighting system support and the lighting system, and provides minimal thermal conduction between the lighting system support and the lighting system. The contactor thus reduces heat transfer from the heat-generating light source to the lighting system support, thereby reducing an amount of heat transferred to the corner of the display case.

16 Claims, 6 Drawing Sheets

(56) References Cited

U.S. PATENT DOCUMENTS 5,072,343 A * 12/1991 Buers ..... 362/125
6,179,434 B1 1/2001 Saraiji
6,325,523 B1 * 12/2001 Santosuosso et al. ..... 362/125
6,406,108 B1 * 6/2002 Upton et al. ..... 312/116
6,578,978 B1 * 6/2003 Upton et al. ..... 362/92
2011/0199767 A1 8/2011 Marquardt et al.

* cited by examiner

Isolines: Temperature [°C]

a. 75 b. 48 c. 34 d. 26

THERMAL MANAGEMENT SOLUTION FOR CASE CORNER LIGHTING SYSTEM

TECHNICAL FIELD

The present invention relates to lighting, and more specifically, to thermal management solutions for lighting systems including solid state light sources.

BACKGROUND

An increasing number of light situations have been developed to use solid state light sources, such as light emitting diodes (LEDs), which can be operated at very low voltages and have an extremely long life. Under general circumstances, solid state light sources operate at low temperatures when compared, for example, with incandescent light sources of similar lumen output. However, solid state light sources frequently require thermal management due to the large numbers of solid state light sources that may be found in, among other things, luminaires.

SUMMARY

Certain applications require that solid state light sources be operated in an area where the temperatures generated by the solid state light sources may provide unwelcome consequences. One such application is where solid state light sources are used to provide lighting in display cases. Particularly with jewelry display cases, solid state light sources are typically mounted in assemblies that utilize high thermal conductivity metals, for example as in the reflectors that control the direction of the light emitted by the solid state light sources to focus on the product (e.g., jewelry) displayed within the case. In such applications, the heat produced by the solid state light sources may be conducted to portions of the case (e.g., the outer edges where customers typically come into contact with the case) that may interfere with customer satisfaction.

Embodiments of the invention provide a thermal management solution for a display case including a corner accessible to human touch. The corner is defined by a horizontal surface and a vertical face. The case has an interior volume to be illuminated, where the light is directed away from the corner. A lighting system support is positioned in the corner, and has an associated lighting system. The lighting system includes a reflector and a heat-generating light source mounted with the reflector. At least one mullion is positioned between the lighting system support and the lighting system. The at least one mullion maintains a desired relative position between the lighting system support and the lighting system. The lighting system has at least a first system side, at least partially co-extensive with a first support side of the lighting system support. A contactor is located between the lighting system support and the assembly, and provides minimal thermal conduction between the lighting system support and the lighting system, such that heat transfer from the heat-generating light source to the lighting system support is reduced, thereby reducing the amount of heat transferred to the corner of the display case.

In an embodiment, there is provided a thermal management system for a display case having a corner. The thermal management system includes: a lighting system support positioned in the corner of the display case; a lighting system comprising a reflector and a heat-generating light source, wherein the heat-generating light source is mounted with the reflector, and wherein the lighting system is associated with the lighting system support; a mullion positioned between the lighting system support and the lighting system, the mullion to maintain a desired relative position between the lighting system support and the lighting system; and a contactor between the lighting system support and the lighting system, wherein the contactor provides minimal thermal conduction between the lighting system support and the lighting system whereby heat transfer from the heat-generating light source to the lighting system support is reduced, thereby reducing an amount of heat transferred to the corner of the display case.

In a related embodiment, the lighting system may include a first system side, the lighting system support may include a first support side, and the first system side may be at least partially co-extensive with the first support side. In a further related embodiment, the contactor may include a plurality of spaced apart projections located between at least the first system side and the first support side.

In a further related embodiment, the lighting system may include a base and the lighting system support may include a second support side. In a further related embodiment, the plurality of spaced apart projections may be located between the base and the second support side.

In another further related embodiment, a subset of the plurality of spaced apart projections may be conical.

In another related embodiment, the lighting system may include a base, the lighting system support may include a first support side and a second support side, and the contactor may include a non-metallic, heat-insulating member positioned between the base and the second support side. In a further related embodiment, the non-metallic, heat-insulating member may include a depending arm positioned between the first support side and the lighting system. In a further related embodiment, the lighting system may include a first system side, and the depending arm may be positioned between the first support side and the first system side.

In yet another related embodiment, the heat-generating light source may include at least one solid state light source. In a further related embodiment, the lighting system may include a luminaire including the at least one solid state light source.

In another embodiment, there is provided a thermal management system for a display case having a corner. The thermal management system includes: a lighting system support positioned in the corner of the display case; a lighting system comprising a reflector and a heat-generating light source, wherein the heat-generating light source is mounted with the reflector, and wherein the lighting system is associated with the lighting system support; and at least one mullion positioned between the lighting system support and the lighting system, wherein the at least one mullion is substantially thermally insulating, the mullion to maintain a desired relative position between the lighting system support and the lighting system and to reduce heat transfer from the heat-generating light source to the lighting system support, thereby reducing an amount of heat transferred to the corner of the display case.

In a related embodiment, the at least one mullion may include a plurality of spaced-apart mullions, wherein a subset of the plurality of spaced-apart mullions may be thermally insulating. In a further related embodiment, the lighting system may include a first system side, the lighting system support may include a first support side, and the first system side may be at least partially co-extensive with the first support side. In a further related embodiment, the plurality of spaced apart mullions may be located between at least the first system side and the first support side.

In another embodiment, there is provided a thermal management system for a display case having a corner. The thermal management system includes: a lighting system support positioned in the corner of the display case, comprising a first support side; a lighting system comprising a reflector and a heat-generating light source, wherein the heat-generating light source comprises at least one temperature-dependent solid state light source, wherein the at least one temperature-dependent solid state light source is mounted with the reflector, wherein the lighting system is associated with the lighting system support, and wherein the lighting system includes a first system side that is at least partially co-extensive with the first support side; a mullion positioned between the lighting system support and the lighting system, the mullion to maintain a desired relative position between the lighting system support and the lighting system; and a contactor between the first system side of the lighting system and the first support side of the lighting system support, wherein the contactor provides minimal thermal conduction between the lighting system support and the lighting system whereby heat transfer from the at least one temperature-dependent solid state light source to the lighting system support is reduced, thereby reducing an amount of heat transferred to the corner of the display case.

BRIEF DESCRIPTION OF THE DRAWINGS

The foregoing and other objects, features and advantages disclosed herein will be apparent from the following description of particular embodiments disclosed herein, as illustrated in the accompanying drawings in which like reference characters refer to the same parts throughout the different views. The drawings are not necessarily to scale, emphasis instead being placed upon illustrating the principles disclosed herein.

DETAILED DESCRIPTION

Figure 1:
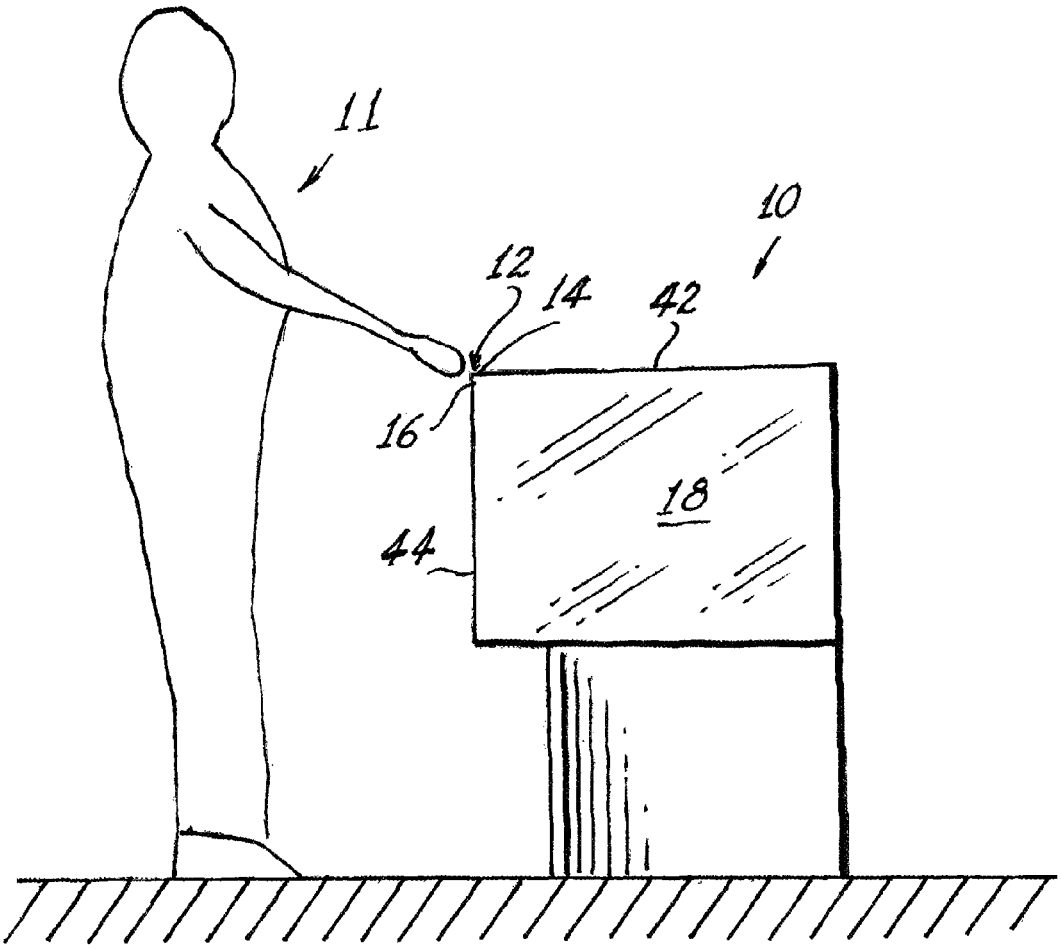
FIG. 1 shows a display case in which may be used a thermal management solution for a case corner lighting system according to embodiments disclosed herein, with a customer in an engaging position.

FIG. 1 shows a display case 10, which includes a corner 12 that is defined by a horizontal surface 14 and a vertical face 16, and comes into contact with a customer 11. The corner 12 is constructed from a thermally conductive material, such as but not limited to a metal such as but not limited to chromium plated stainless steel, aluminum, and the like. The display case 10 includes an upper surface 42 and a front face 44. The upper surface 42 and the front face 44 of the display case 10 generally are made of some type of transparent and/or substantially transparent material, such as but not limited to glass, to permit unrestricted viewing of the merchandise therein. The corner 12 serves to both mount and position the upper surface 42 and the front face 44. An interior volume 18 of the display case 10 is to be illuminated by a lighting system (not shown in FIG. 1, but typically located on the inside of the corner 12).

A thermal management system 100 is shown in detail in FIGS. 2-5. The thermal management system 100 is primarily for use in a display case, such as but not limited to the display case 10 shown in FIGS. 1-5, where the display case 10 includes a corner 12. The thermal management system 100 should reduce the amount of heat that is transferred to the corner 12 by a lighting system 22, where the lighting system 22 generates heat. A lighting system support 20 is positioned in the corner 12 of the display case 10. In some embodiments, the lighting system support 20 is preferably an integral part of the vertical face 16 of the corner 12 and it projects some distance into the interior volume 18. In some embodiments, the lighting system support 20 includes a spacer 56 located between the lighting system support 20 and the upper surface 42 of the display case 10.

The lighting system support 20 provides support for a lighting system 22. The lighting system 22, in some embodiments, is a luminaire 22, and in some embodiments is a retrofit lamp 22 and/or a retrofit-style lamp 22. In all embodiments, the lighting system 22 includes a heat-generating light source 26, which may be but is not limited to at least one solid state light source 27, such as but not limited to a light emitting diode (LED), organic light emitting diode (OLED), polymer light emitting diode (PLED), and the like, and includes combinations thereof. In some embodiments, the LED, OLED, PLED, and/or combinations thereof are temperature-dependent. The lighting system 22 also includes a reflector 24. The heat-generating light source 26 is operatively mounted with the reflector 24. The lighting system 22 is associated with the lighting system support 20.

At least one mullion 25 is positioned between the lighting system support 20 and the lighting system 22, to maintain a desired relative position between the lighting system support 20 and the lighting system 22. The mullion 25 is, in some embodiments, constructed of a suitable plastic or metal. In some embodiments, the mullion 25 includes a sleeve 25' that surrounds a stud 25", as depicted more clearly in FIG. 3. The stud 25" has a lower section 46 that fits into a groove 48 formed in a base 34 of the lighting system 22.

A contactor 32 is located between the lighting system support 20 and the lighting system 22. The contactor 32 provides minimal thermal conduction between the lighting system support 20 and the lighting system 22, whereby heat transfer from the heat-generating light source 26 to the lighting system support 20 is reduced, thereby reducing an amount of heat transferred to the corner 12 of the display case 10. In some embodiments, the lighting system 22 includes a first system side 28, and the lighting system support 20 includes a first support side 30. The first system side 28 is at least partially co-extensive with the first support side 30. The contactor 32, in some embodiments, is located between the first system side 28 of the lighting system 22 and the first support side 30 of the lighting system support 20.

Figure 2:
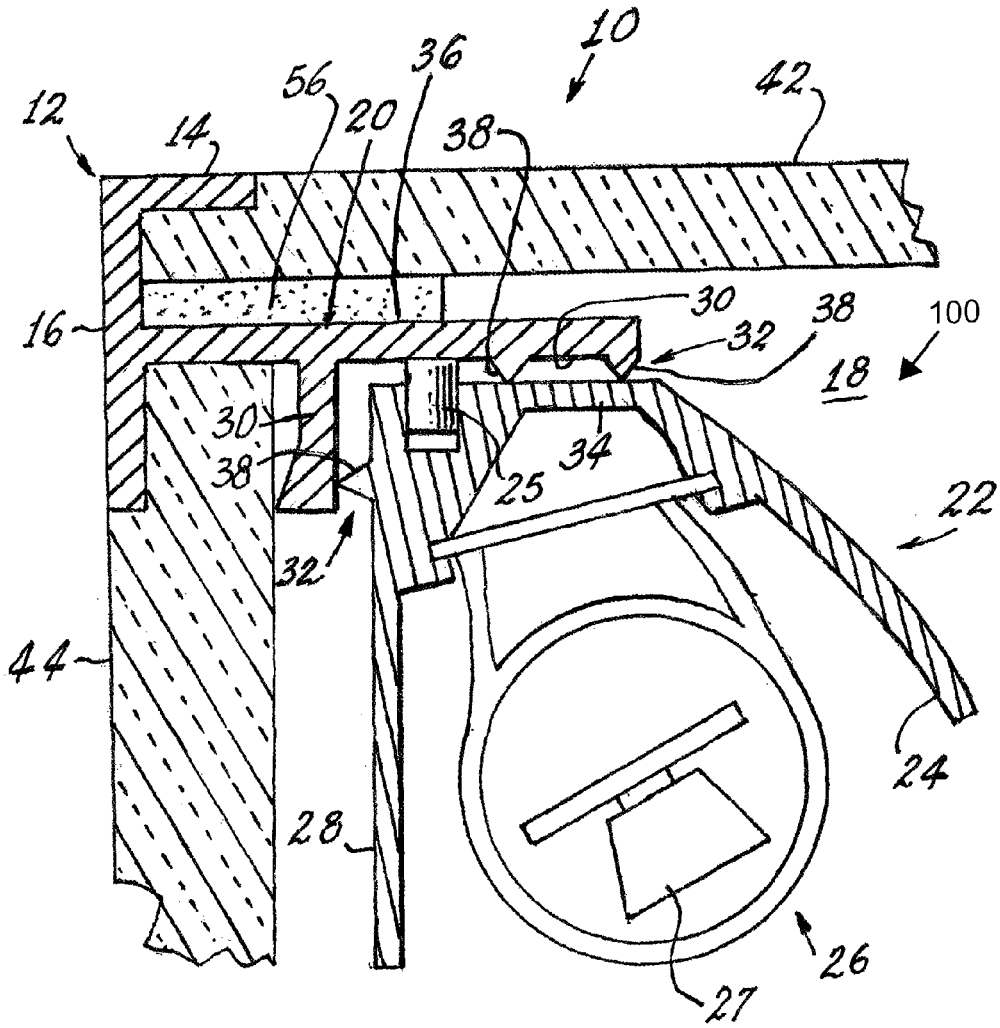
FIG. 2 is a sectional view of a thermal management solution for a case corner lighting system according to embodiments disclosed herein.

In some embodiments, such as shown in FIG. 2, the contactor 32 comprises a plurality of spaced apart projections 38 located between at least the first system side 28 and the first support side 30. In some embodiments, the lighting system support 20 includes a second support side 36, and the plurality of spaced apart projections 38 is located between the base 34 of the lighting system 22 and the second support side 36. In some embodiments, the base 34 and the second support side 36 also are provided with projections of the plurality of spaced apart projections 38. In some embodiments, at least a subset of projections in the plurality of spaced apart projections 38 includes projections that are conical. Alternatively, or additionally, in some embodiments, at least a subset of the projections in the plurality of spaced apart projections 38 includes projections that are ridge-shaped, such as but not limited to a triangular ridge-shape, a saw-tooth ridge-shape, and the like.

Figure 4:
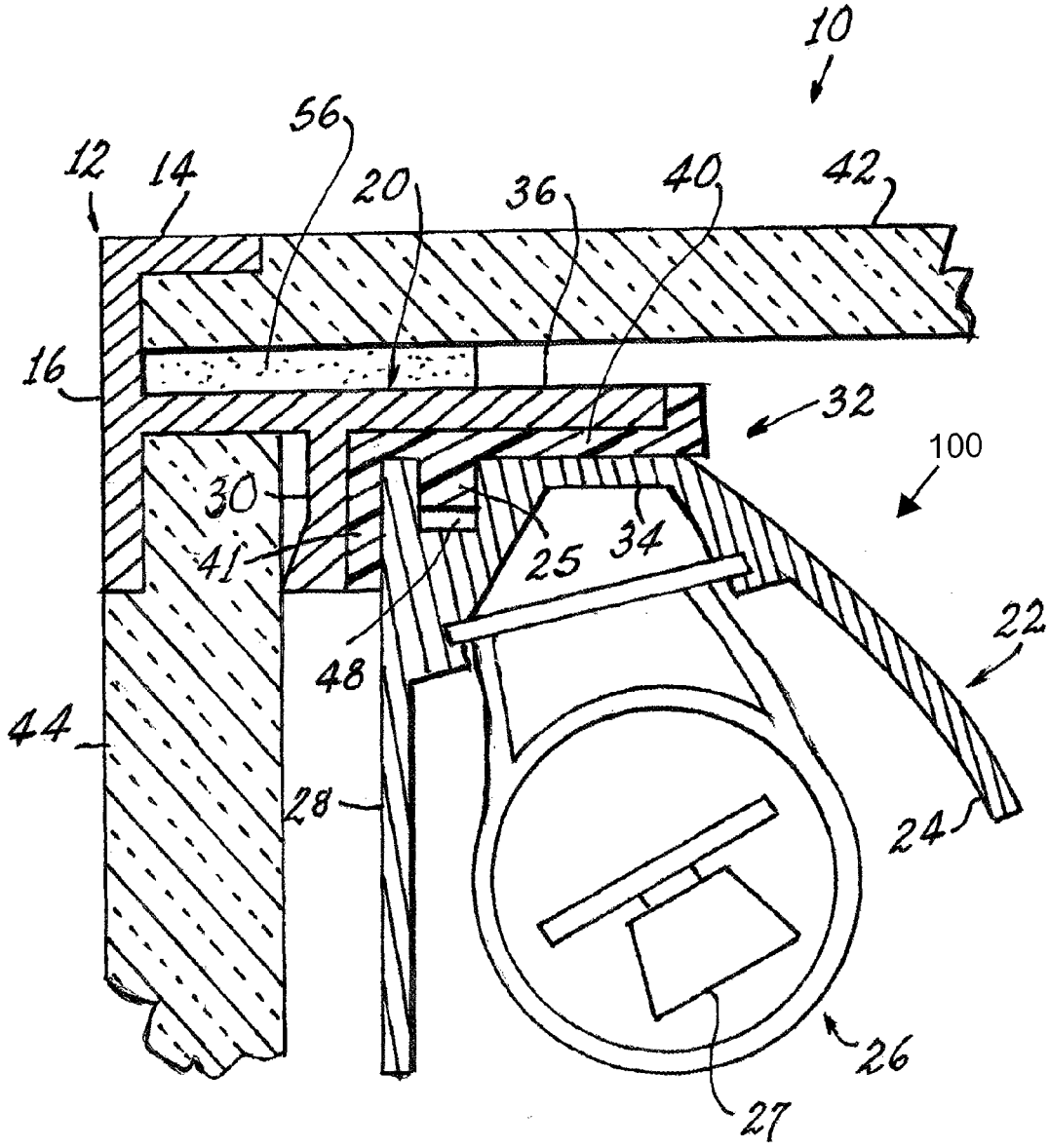
FIG. 4 is a similar view of a thermal management solution for a case corner lighting system according to embodiments disclosed herein.

In FIG. 4, the thermal management system 100 includes the lighting system 22 with the base 34, the lighting system support 22 includes a first support side 30 and a second support side 36, and the contactor 32 comprises a non-metallic, heat-insulating member 40 positioned between the base 34 and the second support side 36. In some embodiments, the non-metallic, heat-insulating member 40 comprises a depending arm 41 positioned between the first support side 30 and the lighting system 22. In some embodiments, the depending arm 41 is positioned between the first support side 30 and the first system side 28. The depending arm 41 may, and in some embodiments does, provide additional positive insulation and support against vibration that may occur from operation of the lighting system 22. The non-metallic, heat-insulating member 40 may be, and in some embodiments is, fixed to the lighting system support 20 by any connection mechanism, such as but not limited to glue, one or more screws, and the like. The at least one mullion 25 may be, and in some embodiments is, an integral part of the non-metallic, heat-insulating member 40. Alternatively, or additionally, the least one mullion 25 may be, and in some embodiments is, an integral part of the lighting system support 20 that projects through an aperture (not shown) in the non-metallic, heat-insulating member 40 for engagement with a groove 48.

Figure 3:
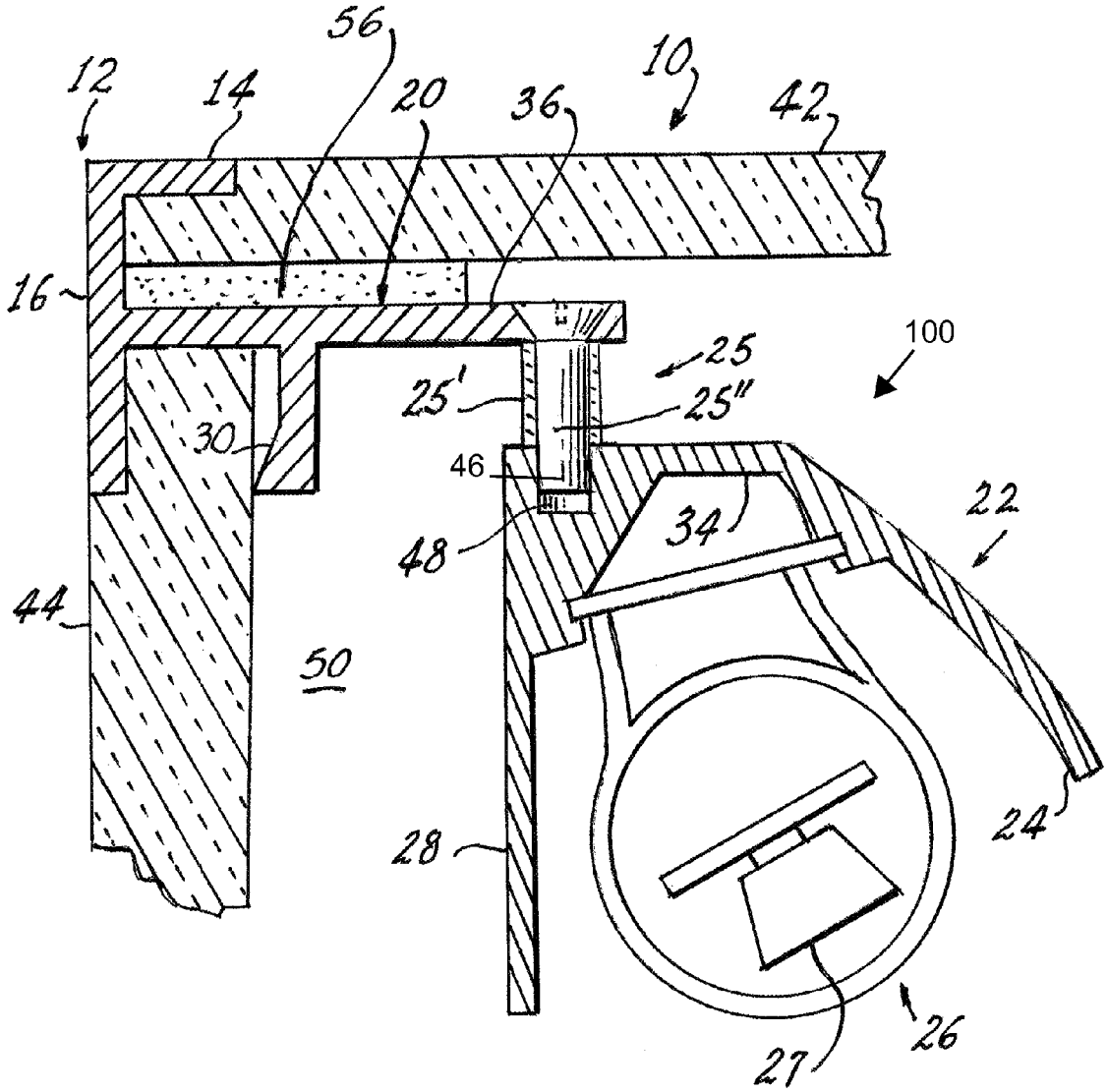
FIG. 3 is a similar view of a thermal management solution for a case corner lighting system according to embodiments disclosed herein.

In the thermal management system 100 shown in FIG. 3, the thermal barrier between the heat-generating light source 26 and the corner 12 is provided at least in part by an air gap. In FIG. 3, the contactor 32 is supplied solely by one or more mullions 25 in a plurality of spaced-apart mullions 25. The groove 48 is moved close to the first system side 28, thus leaving a large air gap 50 between the first system side 28 and an interior of the front face 44 of the display case 10. A subset of the plurality of spaced-apart mullions 25 may be, and in some embodiments are, thermally insulating.

Figure 5:
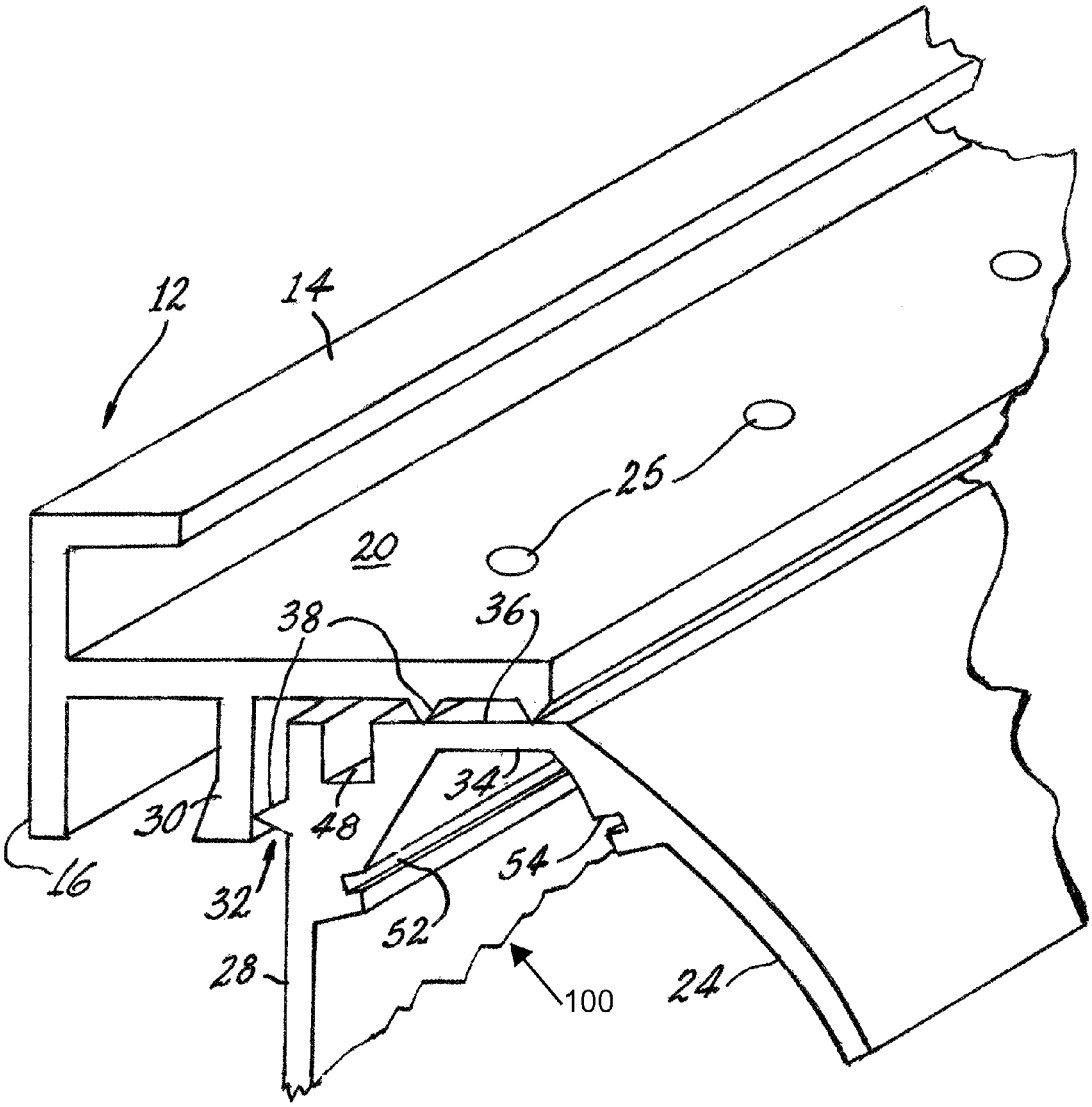
FIG. 5 is a perspective view of the thermal management solution for a case corner lighting system according to embodiments disclosed herein shown in FIG. 2.

In FIG. 5, the lighting system 22 and the corner 12 of the display case 10 are shown with the heat-generating light source 26 omitted for clarity. A mounting structure for the heat-generating light source (not shown) may comprise oppositely disposed slots 52, 54, into which a printed circuit board or other supporting apparatus for the heat-generating light source may be slid. Such an embodiment allows an entire panel of lights, either separate from or part of a luminaire, to be replaced without the necessity of removing the lighting system 22. The plurality of mullions 25 may be set within the lighting system support 20 by any suitable mechanism, such as, for example, but not limited to friction fit, screw threads, or by application of a suitable bonding agent.

Figure 6:
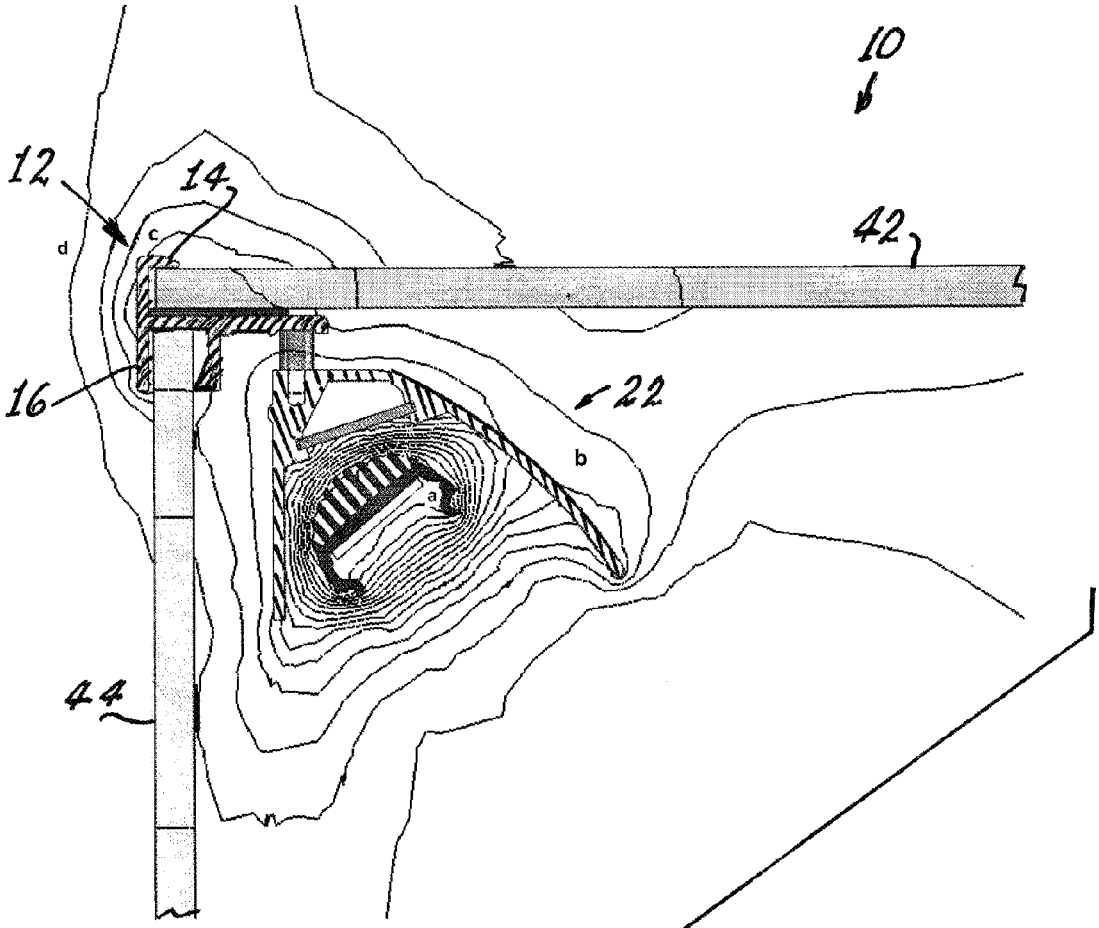
FIG. 6 is a thermal map of a thermal management solution for a case corner lighting system according to embodiments disclosed herein.

FIG. 6 shows an embodiment of the thermal management system 100 with isolines showing the temperature from the thermal energy generated by the lighting system 22 (and more particularly, by the heat-generating light source 26 that is not shown in FIG. 6). The lighting system 22 is in direct contiguous contact with the corner 12, defined by its horizontal surface 14 and the vertical face 16, which in turn is in contact with the upper surface 42 and the front face 44 of the display case 10. Thermal energy created when the heat-generating light source 26 (not shown in FIG. 6) of the lighting system 22 is operating is transferred directly to the entire corner 12, resulting in warm temperatures being available at the outside of the display case 10 at the corner 12. In a prior art system, the temperatures at isolines/isothermes labeled "a", "b", "c" and "d", were measured as, 74.3 degrees Celsius, 46.9 degrees Celsius, 42 degrees Celsius, and 27.7 degrees Celsius, respectively. The isotherm labeled "c", being at the corner 12 of the display case 10, is thus in a location where the customer 11 of FIG. 1 may (and often does) come into contact with the display case 10. The thermal management system 100, according to embodiments described herein, reduces the temperature at the isotherm labeled "c" to 34 degrees Celsius, a reduction of 8 degrees Celsius over the prior art.

Unless otherwise stated, use of the word "substantially" may be construed to include a precise relationship, condition, arrangement, orientation, and/or other characteristic, and deviations thereof as understood by one of ordinary skill in the art, to the extent that such deviations do not materially affect the disclosed methods and systems.

Throughout the entirety of the present disclosure, use of the articles "a" and/or "an" and/or "the" to modify a noun may be understood to be used for convenience and to include one, or more than one, of the modified noun, unless otherwise specifically stated. The terms "comprising", "including" and "having" are intended to be inclusive and mean that there may be additional elements other than the listed elements. The term "and/or" includes any and all combinations of one or more of the associated listed items.

Although the terms "first", "second", "third", etc. may be used to describe various elements, components, regions, layers, and/or sections, these elements, components, regions, layers, and/or sections are not to be limited by theses terms as they are used only to distinguish one element, component, region, layer, or section from another element, component, region, layer, or section. Thus, a first element, component, region, layer, or section could be termed a second element, component, region, layer, or section without departing from the scope and teachings of the invention.

Elements, components, modules, and/or parts thereof that are described and/or otherwise portrayed through the figures to communicate with, be associated with, and/or be based on, something else, may be understood to so communicate, be associated with, and or be based on in a direct and/or indirect manner, unless otherwise stipulated herein. Further, when an element or layer is referred to herein as being "on," "connected to", or "coupled to" another element or layer, it may be, and in some embodiments is, directly on, connected to, or coupled to the other element or layer, or intervening elements or layers may be present. In contrast, when an element is referred to as being "directly on," "directly connected to", or "directly coupled to" another element or layer, there are no intervening elements or layers present.

Spatially relative terms, such as "beneath," below," upper," "lower," "above" and the like may be, and in some embodiments are, used herein for ease of description to describe one element or feature's relationship to another element(s) or feature(s) as illustrated in the drawings. These spatially relative terms are intended to encompass different orientations of the device in use or operation, in addition to the orientation shown in the drawings. For example, if the device(s) and/or system(s) in the drawings is/are turned over, elements described as "below" or "beneath" other elements or features would then be oriented "above" the other elements or features. Thus, the exemplary term "below" may, and in some embodiments does, encompass both an orientation of above and below. The device(s) and/or system(s) may be otherwise oriented (e.g., rotated 90 degrees or at other orientations) and the spatially relative descriptors used herein interpreted accordingly.

Although the methods and systems have been described relative to a specific embodiment thereof, they are not so limited. Obviously many modifications and variations may become apparent in light of the above teachings. Many additional changes in the details, materials, and arrangement of parts, herein described and illustrated, may be made by those skilled in the art.

What is claimed is:

1. A thermal management system for a display case having a corner, comprising:

a lighting system support positioned in the corner of the display case;

a lighting system comprising a reflector and a heat-generating light source, wherein the heat-generating light source is mounted with the reflector, and wherein the lighting system is associated with the lighting system support;

a mullion positioned between the lighting system support and the lighting system, the mullion to maintain a desired relative position between the lighting system support and the lighting system; and a contactor between the lighting system support and the lighting system, wherein the contactor provides minimal thermal conduction between the lighting system support and the lighting system whereby heat transfer from the heat-generating light source to the lighting system support is reduced, thereby reducing an amount of heat transferred to the corner of the display case.

2. The thermal management system of claim 1, wherein the lighting system comprises a first system side, wherein the lighting system support comprises a first support side, and wherein the first system side is at least partially co-extensive with the first support side.

3. The thermal management system of claim 2, wherein the contactor comprises a plurality of spaced apart projections located between at least the first system side and the first support side.

4. The thermal management system of claim 3, wherein the lighting system comprises a base and wherein the lighting system support comprises a second support side.

5. The thermal management system of claim 4, wherein the plurality of spaced apart projections is located between the base and the second support side.

6. The thermal management system of claim 3, wherein a subset of the plurality of spaced apart projections are conical.

7. The thermal management system of claim 1, wherein the lighting system comprises a base, wherein the lighting system support comprises a first support side and a second support side, and wherein the contactor comprises a non-metallic, heat-insulating member positioned between the base and the second support side.

8. The thermal management system of claim 7, wherein the non-metallic, heat-insulating member comprises a depending arm positioned between the first support side and the lighting system.

9. The thermal management system of claim 8, wherein the lighting system comprises a first system side, and wherein the depending arm is positioned between the first support side and the first system side.

10. The thermal management system of claim 1, wherein the heat-generating light source comprises at least one solid state light source.

11. The thermal management system of claim 10, wherein the lighting system comprises a luminaire including the at least one solid state light source.

12. A thermal management system for a display case having a corner, comprising:

a lighting system support positioned in the corner of the display case;

a lighting system comprising a reflector and a heat-generating light source, wherein the heat-generating light source is mounted with the reflector, and wherein the lighting system is associated with the lighting system support; and at least one mullion positioned between the lighting system support and the lighting system, wherein the at least one mullion is substantially thermally insulating, the mullion to maintain a desired relative position between the lighting system support and the lighting system and to reduce heat transfer from the heat-generating light source to the lighting system support, thereby reducing an amount of heat transferred to the corner of the display case.

13. The thermal management system of claim 12, wherein the at least one mullion comprises a plurality of spaced-apart mullions, wherein a subset of the plurality of spaced-apart mullions are thermally insulating.

14. The thermal management system of claim 13, wherein the lighting system comprises a first system side, wherein the lighting system support comprises a first support side, and wherein the first system side is at least partially co-extensive with the first support side.

15. The thermal management system of claim 14, wherein the plurality of spaced apart mullions is located between at least the first system side and the first support side.

16. A thermal management system for a display case having a corner, comprising:

a lighting system support positioned in the corner of the display case, comprising a first support side;

a lighting system comprising a reflector and a heat-generating light source, wherein the heat-generating light source comprises at least one temperature-dependent solid state light source, wherein the at least one temperature-dependent solid state light source is mounted with the reflector, wherein the lighting system is associated with the lighting system support, and wherein the lighting system includes a first system side that is at least partially co-extensive with the first support side;

a mullion positioned between the lighting system support and the lighting system, the mullion to maintain a desired relative position between the lighting system support and the lighting system; and a contactor between the first system side of the lighting system and the first support side of the lighting system support, wherein the contactor provides minimal thermal conduction between the lighting system support and the lighting system whereby heat transfer from the at least one temperature-dependent solid state light source to the lighting system support is reduced, thereby reducing an amount of heat transferred to the corner of the display case.

* * * * *